US006680450B2

(12) United States Patent
Frohne et al.

(10) Patent No.: US 6,680,450 B2
(45) Date of Patent: Jan. 20, 2004

(54) ELECTRIC SWITCH WITH DAMPING ELEMENTS TO MINIMIZE SWITCHING NOISE

(75) Inventors: Hans-Joachim Frohne, Lehre (DE); Klaus Müller, Aach (DE); Jürgen Girke, Gaienhofen (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 8 days.

(21) Appl. No.: 10/135,234

(22) Filed: Apr. 30, 2002

(65) Prior Publication Data

US 2003/0075430 A1 Apr. 24, 2003

(30) Foreign Application Priority Data

Oct. 22, 2001 (DE) ..... 201 17 282 U

(51) Int. Cl.[7] ..... H01H 3/60
(52) U.S. Cl. ..... 200/565; 200/301
(58) Field of Search ..... 200/301, 336, 200/565, 327

(56) References Cited

U.S. PATENT DOCUMENTS 3,711,669 A * 1/1973 Keranen ..... 200/301
4,490,588 A 12/1984 Guenther et al.
5,012,056 A * 4/1991 Abel et al. ..... 200/519
5,418,530 A * 5/1995 Moore et al. ..... 200/345 X
6,419,068 B1 * 7/2002 Stephan et al. ..... 192/219.5

FOREIGN PATENT DOCUMENTS

| | | |
|---|---|---|
| DE | 640 268 | 12/1936 |
| DE | 644 457 | 4/1937 |
| DE | 31 49 944 A1 | 7/1983 |
| DE | 37 27 495 C1 | 11/1988 |
| DE | 194 03 904 A1 | 8/1996 |
| DE | 100 63 385 A1 | 6/2001 |

* cited by examiner

*Primary Examiner*—Renee Luebke
(74) *Attorney, Agent, or Firm*—Tarolli, Sundheim, Covell & Tummino L.L.P.

(57) ABSTRACT

An electric switch has a switch housing, a knob mounted in the housing, a guide gate having latching recesses and arranged inside the switch housing, and a spring-loaded cam follower guided by the guide gate. The switching positions of the switch are defined by interaction of the cam follower with the guide gate and with its latching recesses. The guide gate has damping elements made of elastic material and fitted in the latching recesses.

5 Claims, 1 Drawing Sheet

ELECTRIC SWITCH WITH DAMPING ELEMENTS TO MINIMIZE SWITCHING NOISE

The present invention relates to an electric switch with a switch housing, a knob mounted in the housing, a guide gate having latching recesses and arranged inside the switch housing, and as a spring-loaded cam follower guided in the guide gate. In such a switch, the switching positions of the switch are defined by the interaction of the cam follower with the guide gate and with its latching recesses.

BACKGROUND OF THE INVENTION

Electric switches in which the various switching positions have to be assumed precisely and mechanically stably include, for example, light switches in vehicles. Since the knob latches in the various switching positions, the operator also receives tactile feedback on the successful switching operation. A pressure spring presses the cam follower against the wall of the guide gate with considerable force in order to ensure a positive latching operation and stable latching positions. However, the switching operations are accompanied by a noticeable switching noise, which has a negative impact on the quality impression.

SUMMARY OF THE INVENTION

The invention provides an electric switch with which the switch noises are reduced and, due to their composition, do not make a negative impression on the quality of the switch. According to the invention, the guide gate has damping elements made of elastic material and fitted in the latching recesses. Therefore, at least in the latching positions, the cam follower does not strike the wall of the guide gate directly, since the latter is covered there by the damping elements. The damping elements are preferably made of an elastomeric material by means of a two-component injection molding technique.

In the preferred embodiment, the guide gate is formed on a separate guide part that is uncoupled from the switch housing by means of a layer of elastic material. Since the switch noises originate on the guide part, a damping of the connection between the guide part and the switch housing is very effective at further reducing noises.

The invention is especially advantageously used in a rotary switch, particularly in a light switch for vehicles.

BRIEF DESCRIPTION OF THE DRAWINGS

Additional features and advantages of the invention ensue from the description below of a preferred embodiment, with reference to the accompanying drawings. The drawings show the following.

DESCRIPTION OF THE PREFERRED EMBODIMENTS

Figure 1:
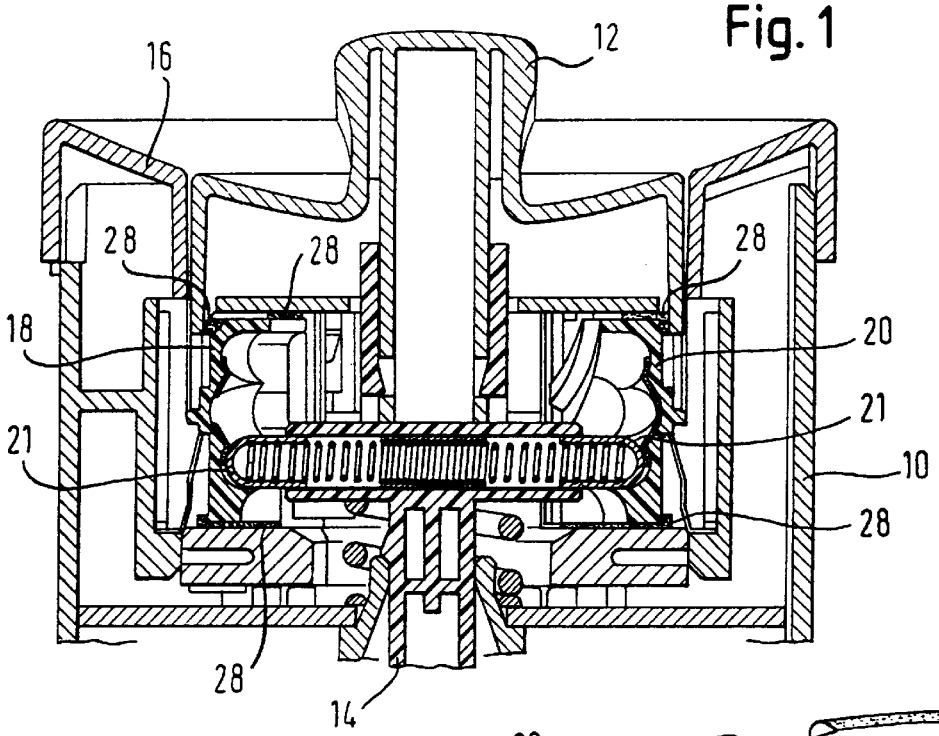
FIG. 1—an axial partial section of an electric rotary switch.

Only the operating part of the electric rotary switch is shown in FIG. 1. The operating part of the electric rotary switch includes a generally cylindrical area of a switch housing 10, a knob part 12 configured as a control lever that is non-rotatingly coupled to a control shaft 14 situated coaxially in the switch housing 10, and a ring cover 16 that surrounds the knob part 12 and extends over the open end of the switch housing 10. Two diametrically opposed guide pieces 18, 20 made of plastic are arranged in the switch housing. On the inner circumferential surface—designated in FIG. 2 as 18*a*—of each guide piece 18, 20, there is a guide gate with several guide tracks, which are designated in FIG. 2 as 18*b* and 18*c*. The guide tracks 18*b* and 18*c* have a shared section and two track sections that branch off from said section and that are situated at different heights.

The switching shaft 14 has two radial cam supports that are diametrically opposite from each other, each having a latching cam, 21 in FIG. 1, which is loaded radially outward by a pressure spring, forming a cam follower and running in the guide tracks of the switching gate of the guide part 18 and 20 that is arranged on the opposite side. The pressure spring presses the latching cam 21 against the wall of the guide link.

Figure 2:
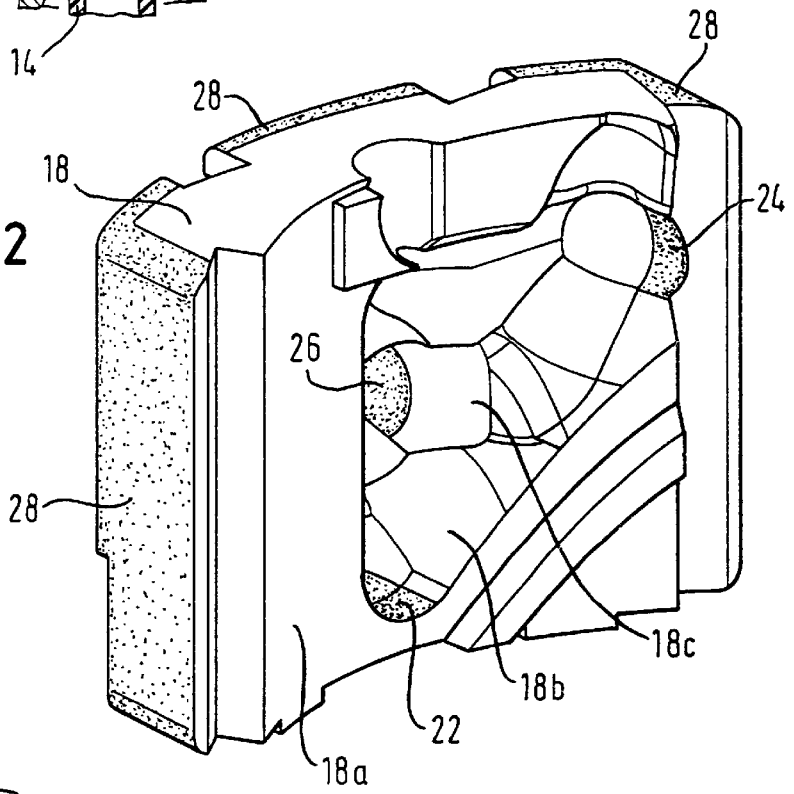
FIG. 2—an enlarged perspective view of a guide part of the rotary switch.
Figure 3:
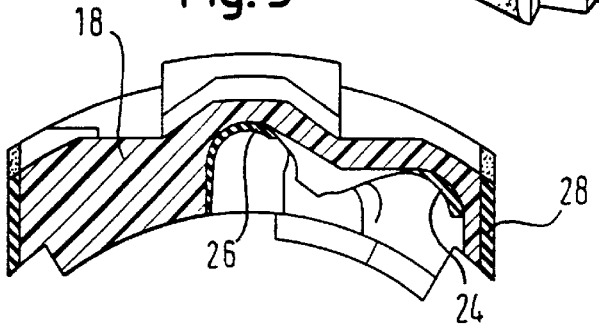
FIG. 3—a radial section of the guide part shown in FIG. 2.

As is shown especially clearly in FIG. 2, the guide tracks 18*b*, 18*c* of the guide gate are each provided with a latching recess at the three latching positions provided for this switch, and a damping element 22, 24, 26 made of elastomeric material is fitted in said latching recess. Moreover, the outer circumference of the guide parts 18, 20 are provided with a damping layer 28 made of elastomeric material. The damping elements 22, 24, 26 as well as the damping layer 28 are made of plastic together with the guide part 18 and 20 by means of a two-component injection molding technique.

In the switch housing 10, there are wall parts between which the guide parts 18, 20 are embedded. These wall parts and the guide parts are only in contact via the damping layer 28.

The damping elements 22, 24, 26 considerably damp the switching operations when the latching cam 21 catches in the latching indentations. Moreover, the noise transmission from the guide parts 18, 20 to the switch housing 10 is damped by the damping layer 28. These measures lower the absolute switching noise level so that it does not make an unpleasant impression on the quality of the switch.

What is claimed is:

1. An electric switch with a switch housing, a knob mounted in said housing, a guide gate having latching recesses and arranged inside the switch housing, and a spring-loaded cam follower guided by said guide gate, interaction of the cam follower with the guide gate and with the latching recesses defining a plurality of switching positions of the switch, wherein said guide gate has damping elements made of elastic material and fitted in the latching recesses.

2. The switch according to claim 1, wherein said guide gate is formed on a separate guide part that is uncoupled from the switch housing by means of a layer of elastic material.

3. The switch according to claim 1, wherein the elastic material is an elastomer.

4. The switch according to claim 1, wherein said damping elements are made by means of a two-component injection molding technique.

5. The switch according to claim 1, wherein said knob is coupled to an axle mounted rotatably in the switch housing and said guide gate is arranged coaxially with said axle.

* * * * *